US005127242A

United States Patent [19]

Mitsumoto

[11] Patent Number: 5,127,242

[45] Date of Patent: Jul. 7, 1992

[54] POCKETED FABRIC WITH RIB KNITTING AND ITS KNITTING METHOD

[75] Inventor: Shigenobu Mitsumoto, Wakayama, Japan

[73] Assignee: Shima Seiki Mfg. Ltd., Wakayama, Japan

[21] Appl. No.: 622,686

[22] Filed: Dec. 5, 1990

[30] Foreign Application Priority Data

Dec. 8, 1989 [JP] Japan ..... 1-319103

[51] Int. Cl.[5] ..... D04B 1/22

[52] U.S. Cl. ..... 66/200; 66/172 R; 66/201

[58] Field of Search ..... 66/21, 172 R, 173, 196, 66/197, 200, 201

*Primary Examiner*—Werner H. Schroeder
*Assistant Examiner*—John J. Calvert
*Attorney, Agent, or Firm*—Edwin E. Greigg; Ronald E. Greigg

[57] ABSTRACT

A method and apparatus for knitting a pocket on a knit type of clothing such as a sweater. The apparatus includes a flat knitting machine having multiple front and back knitting needles operational in parallel. The pocket is knitted by the front and rear needles by knitting a portion of the pocket with some needles and then transferring the stitches to other needles for knitting other parts of the pocket.

2 Claims, 5 Drawing Sheets

POCKETED FABRIC WITH RIB KNITTING AND ITS KNITTING METHOD

BACKGROUND OF THE INVENTION

The present invention relates to a knit fabric for forming a pocket reinforced by rib knitting or the like in an upper opening part integrally, for example, in the front body portion of knit clothes such as a sweater and cardigan, and a knitting method of such knit fabric.

Generally, when forming a pocket in the front body portion of knit clothes, a knit fabric formed in a shape of a pocket is made, and this knit fabric is sewn in a desired position to form a pocket.

In such manner, however, the knit fabric for the pocket is manually sewn into the front body portion of the knit clothes, and the knit fabric for a pocket formed by knitting tends to curl inward in the peripheral part and is hard to handle, and the knit fabric for a pocket is easily deformed, and it takes considerable labor in this sewing work, and the productivity is extremely poor.

In particular, if the knit fabric has patterns, pattern matching is very difficult, and the above problems are particularly notable.

To solve such problems, the present applicant previously proposed a method of using a flat knitting machine comprising at least a pair of front knitting needles and opposing rear knitting needles, and knitting the front body portion (the front fabric) from the lower end to the pocket knitting position by the front knitting needle, knitting the front body portion in the pocket area (the pocket front fabric) by the rear knitting needle, feeding the knitting yarn also to the rear knitting needle at the pocket position, knitting the front part of the pocket (the pocket face side) by the front knitting needle, and knitting the pocket with the side edge of the pocket face side being braided into the front fabric, thereby forming the pocket integrally in a state in which both side edges are braided into the front fabric. Such a disclosure has been made in a Japanese patent application which has been laid open under publication No. Hei 2-300357, on which examination has not yet been requested.

The opening of the pocket in knit clothes must be reinforced by rib knitting or the like for the sake of design or function, but in the previous proposal of the present applicant, when knitting the pocket, stitches are formed by both front knitting needles and rear knitting needles to form a "full" state, and the rib knitting formed by the front knitting needles and rear knitting needles is not achieved, and therefore the knit fabric of the pocket was knit in the same texture as the front fabric of the front body portion and was less tenacious, and the commercial value was lowered.

Accordingly, in order to reinforce the opening portion of the pocket, the opening was folded over to form a tubular shape, and padding was inserted into this tube, and both ends of the pocket face side was sewn to the front fabric, but such reinforcing process of the opening caused lower productivity.

OBJECT AND SUMMARY OF THE INVENTION

The invention has been made in the light of the above problems, and is intended to present a present pocketed knit fabric having rib knitting with the pocket opening reinforced by rib knitting, without sacrificing the productivity, and its knitting method.

BRIEF DESCRIPTION OF THE DRAWINGS

The drawings illustrate an embodiment of the knitting method of a pocketed knit fabric having rib knitting according to the invention, in which.

DETAILED DESCRIPTION OF THE PREFERRED EMBODIMENT

Figure 1:
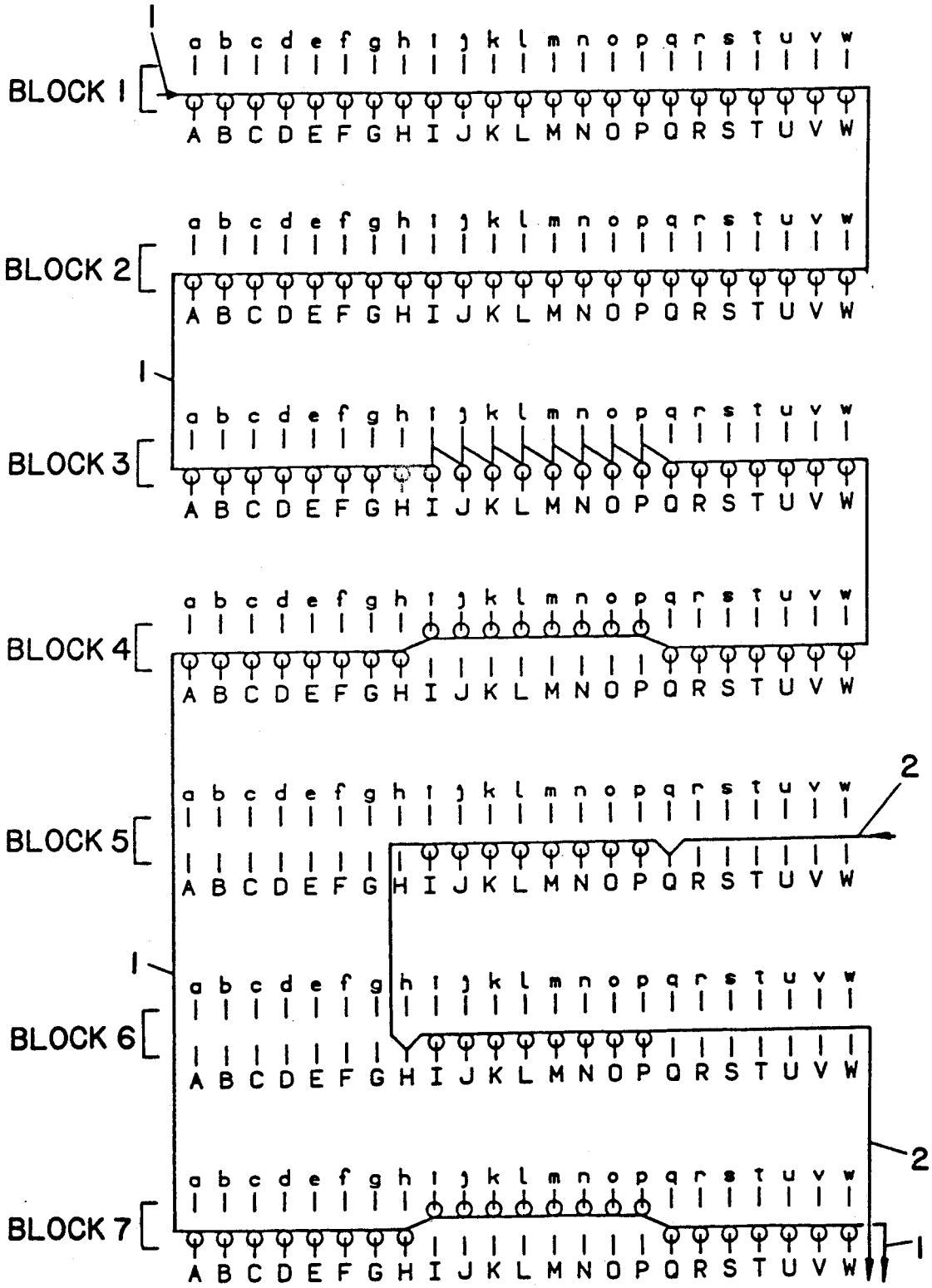
FIG. 1 is a knitting diagram in a principal course from knitting of the front body till knitting of a pocket.

Referring now to the drawings, an embodiment of the invention is described below.

The knitting machine used in this embodiment is a flat knitting machine having multiple knitting needles disposed slidably in forward and backward directions on the top of the needle beds (not shown) arranged in a confronting V-figure in the side view.

FIG. 1 is a knitting diagram in a principal course from the knitting of the front body till the knitting of the pocket, in which alphabetic capital letters A, B, C, . . . , denote the front knitting needles, and the lower case letters a, b, c, . . . , are rear knitting needles.

In the diagram, in block 1 and block 2 knitting yarn 1 for knitting the front body is fed from the carrier outside the drawing into the from knitting needles A, B, C, . . . , which are controlled by a carriage (not shown), and knitting is performed, and this operation is repeated to knit the lower half of the front body.

In the block 3, at the position of forming the bottom of the pocket, knitting yarn 1 is also fed to the front knitting needles I, J, K, . . . , N, O, P and the rear knitting needles i, j, k, . . . , n, o, p corresponding to the width of the pocket.

In block 4, the knitting yarn 1 is fed to the front knitting needles A, B, C, . . . , excluding the front knitting needles I, J, K, . . . , N, O, P and the rear knitting needles i, j, k, . . . , n, o, p, thereby knitting the front body portion.

In block 5 and block 6, the knitting yarn 2 for knitting the pocket is fed to the front knitting needles I, J, K, . . . , N, O, P, corresponding to the width of the pocket, and the front fabric of the pocket is knit in the state of tack joint between the needles Q, H, and rear knitting needles q, h for braiding both edges of the pocket by this knitting yarn 2.

At the same time, by the knitting yarn 1 in the block 7, the front fabric of the front body is also knitted by the front knitting needles A, B, C, . . . , excluding the front knitting needles I, J, K, . . . , N, O, P corresponding to the width of the pocket, and the rear knitting needles i, j, k, . . . , n, o, p.

Figure 2:
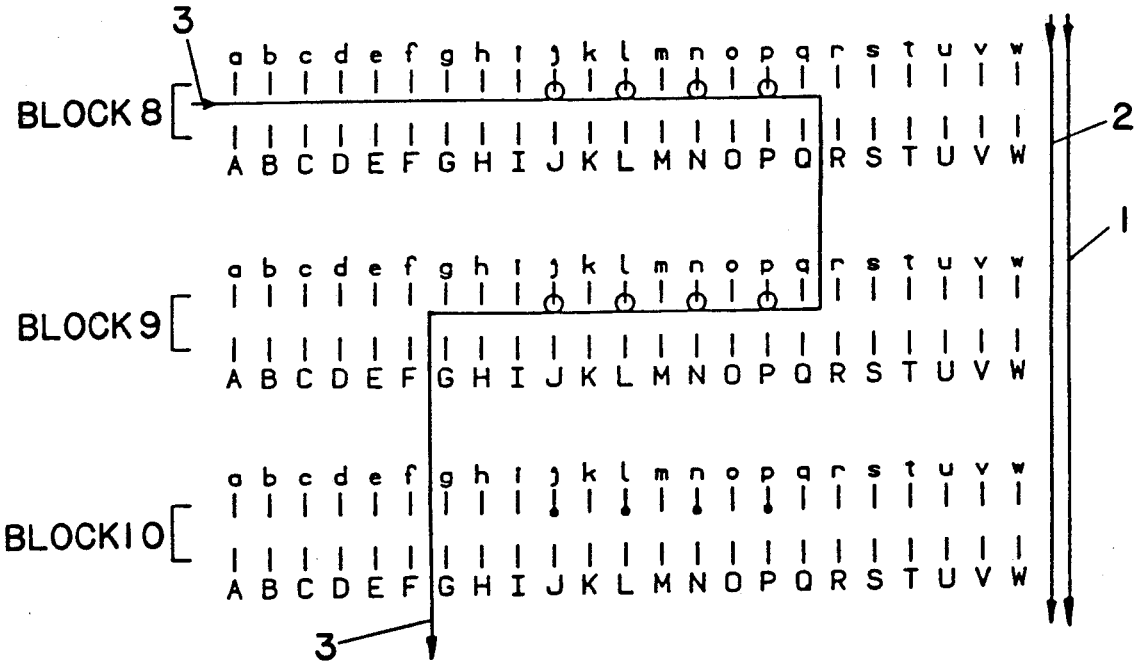
FIG. 2 is a knitting diagram for rib knitting to be formed in the upper end of the pocket.

Thereafter, by the number of specified courses corresponding to the depth of the pocket, the operation from block 4 to block 7 is repeated, and the face side of the bag-shaped pocket is knitted with the side edges and the bottom formed in one body with the front body portion. In succession, in block 8 and block 9 in FIG. 2, when the knitting position comes to the rib knitting part of the upper end of the pocket, the rear knitting needles i, j, k, . . . , n, o, p so far knitting the front fabric of the front body corresponding to the width of the pocket are fed with non-unraveling yarn 3 made of heat shrink yarn at every other needle, j, l, . . . , n, p, thereby forming a loop.

In block 10, the stitches hooked on the rear knitting needles j, l, . . . , n, p are let off, and the needles j, l, . . . , n, p become empty (indicated by black spot in the diagram).

Figure 3:
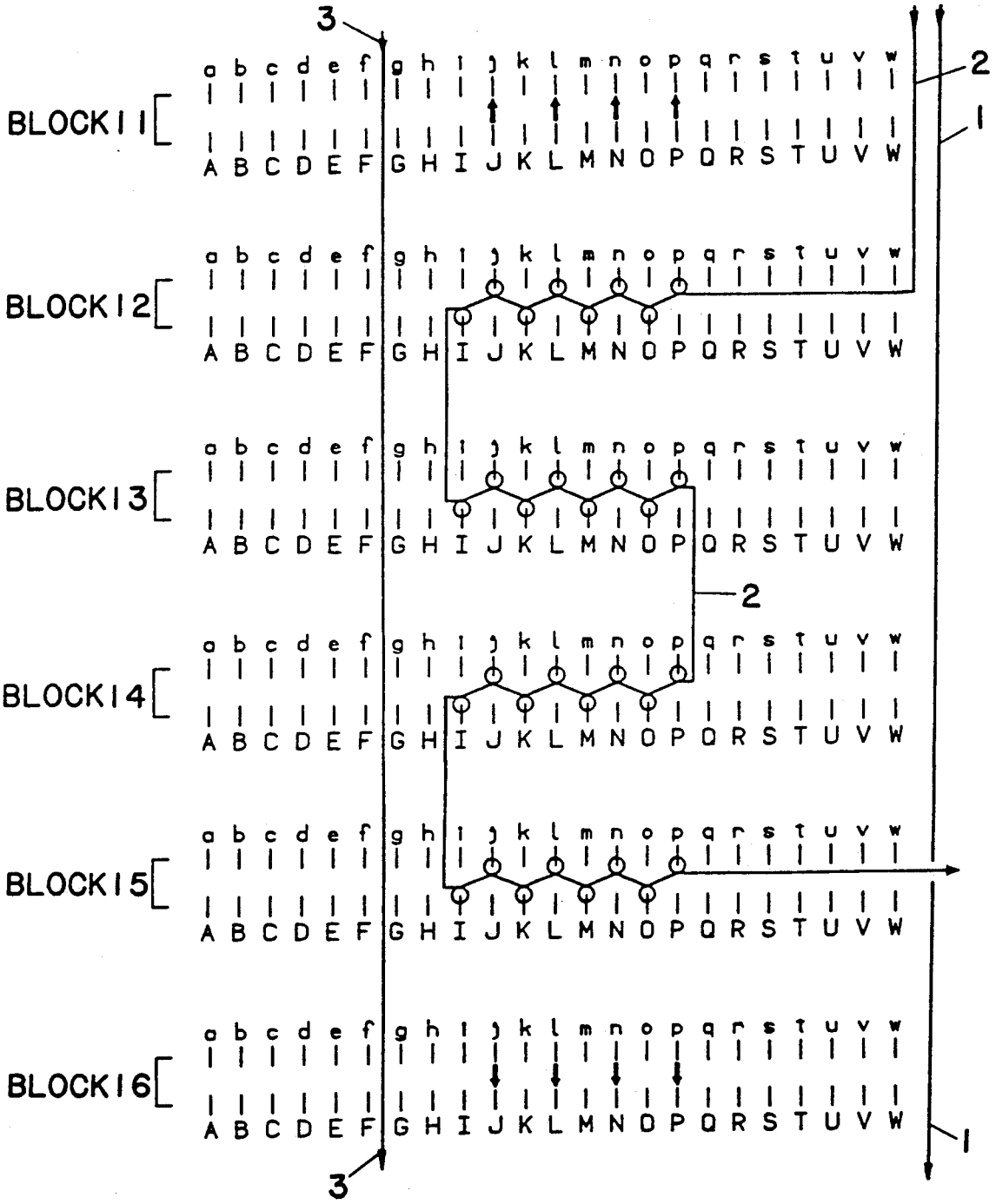
FIG. 3 is a knitting diagram for rib knitting.

In block 11 in FIG. 3, the stitches are transferred from the front knitting needle J, L, . . . , N, P corresponding to the empty needle j, l, . . . , n, p, and through the operation from block 12 to block 15 thereafter, the rib knitting is formed by the rear knitting needles j, l, . . . , n, p, and front knitting needles I, K, . . . , M, O. When the rib knit fabric reaches a specified number of courses, in block 16, the stitches of the rear knitting needles j, l, . . . , n, p forming the rib knitting are transferred to the corresponding front knitting needles J, L, . . . , N, P, and the knitting motion of the rear knitting needles j, l, . . . , n, p is stopped.

Figure 4:
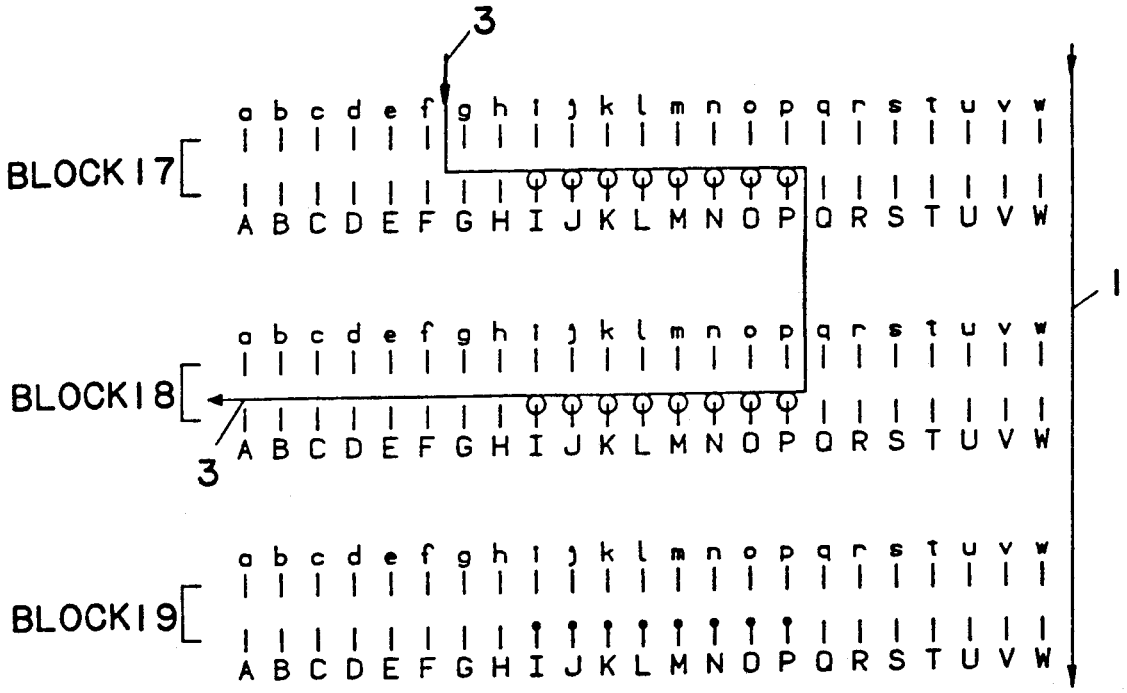
FIG. 4 is a knitting diagram for processing of the upper end of rib knitting.

When the stitches of the rear knitting needles j, l, . . . , n, p are transferred to the front knitting needles J, L, . . . , N, P, in block 17 and block 18 in FIG. 4, the non-unraveling yarn 3 made of heat shrink yarn is fed to the front knitting needles J, K, L, . . . , N, O, P, to form a loop, and in block 19, the stitches are cast off, thereby forming the opening of the pocket reinforced by rib knitting.

When feeding the non-unraveling yarn 3 to the upper end of the rib knitting and processing the stitches as in this embodiment, this non-unraveling yarn 3 portion is folded inward in the pocket to be linked at the time of finishing, but such finishing is not needed if binding off, instead of using the non-unraveling yarn 3.

Figure 5:
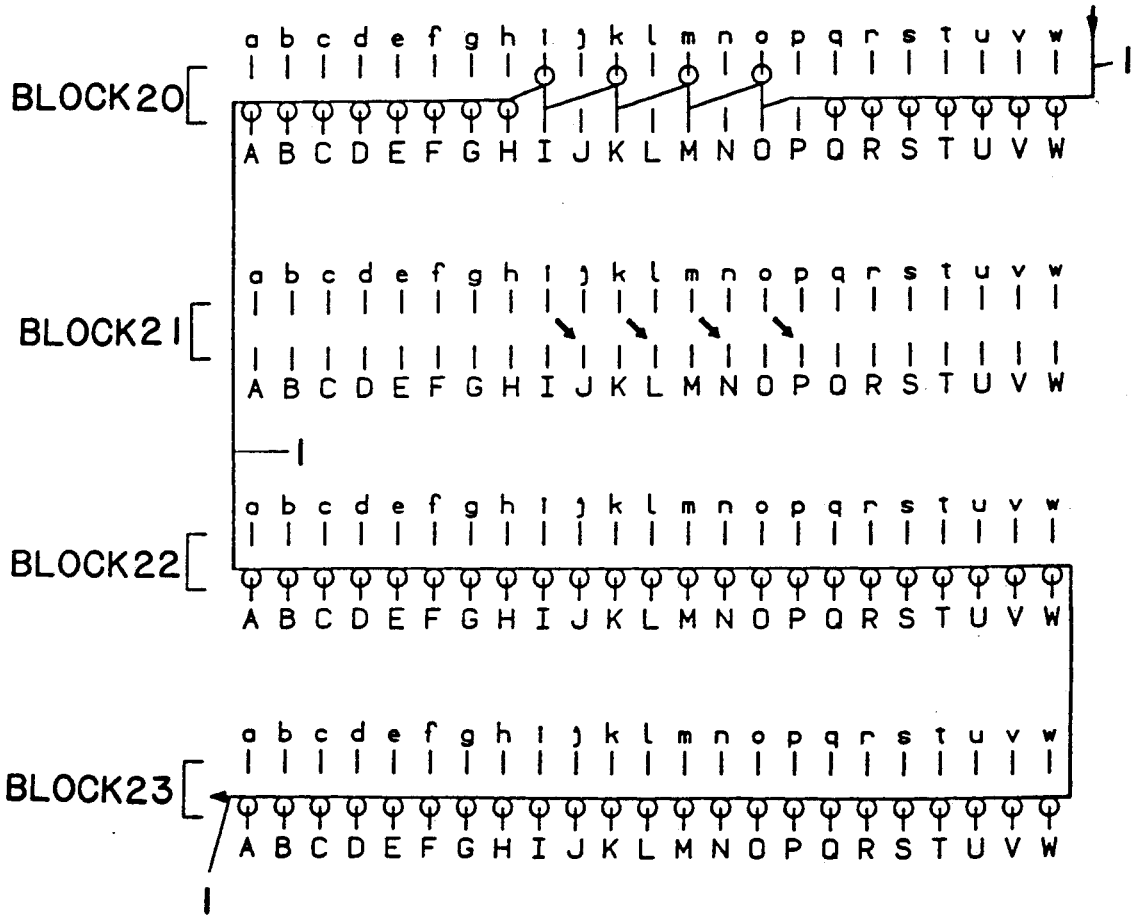
FIG. 5 is a knitting diagram for knitting of the front body.

To the needles, I, K, . . . , M, O of the empty front knitting needles I, J, K, . . . , N, O, P, the knitting yarn 1 is fed in block 20 in FIG. 5, together with the rear knitting needles i, k, . . . , m, o, and, in block 21, the stitches of the rear knitting needles i, k, . . . , m, o are transferred to the empty needles J, L, . . . , N, P of the front knitting needles.

Thereafter, the knitting yarn 1, is fed to all of the front knitting needles A, B, C, . . . , and knitting of the block 22 and block 23 is repeated to knit the front body.

The knit fabric of the pocket having the opening reinforced by rib knitting formed in the front body only by sewing both ends of the rib knitting portion to the front body.

The stitches being cast off by feeding the non-unraveling yarn 3 to form the rib knitting are held securely as the non-unraveling yarn 3 is shrunk by the heat at the time of steam treatment when finishing the sweater or the like, so that the stitches are securely prevented from being unraveled.

Furthermore, when the stitch portion being cast off by feeding the non-unraveling yarn 3 is sewn into the knit fabric of the front body by means of a zig-zag sewing machine or the like, this sewn portion is concealed by the pocket, and the appearance is not spoiled, and the strength of the cast-off stitch portion is reinforced.

In this embodiment, the example is a flat knitting machine having multiple knitting needles planted parallel on a pair of confronting needle beds in the longitudinal direction, but the invention may be, needless to say, also embodied in a machine having two or more pairs of needle beds, and other modifications are also possible; for example, not limited to the operation of knitting the front fabric by the front knitting needles, the front fabric may be knitted by both front and rear knitting needles, or by the rear knitting needles.

Moreover, in the foregoing embodiment, the non-unraveling yarn is made of heat shrink yarn, but instead it may be made of hot melt yarn, and the same effect of preventing unraveling stitches is obtained.

What is claimed is:

1. A pocketed knit fabric with a rib knitted portion comprising a front fabric, a pocket extending from the front fabric, a pocket face portion knitted with side edges formed from a bottom of the pocket and braided into the front fabric, the rib knitted portion formed continuously from the face portion in an upper portion of the pocket and cast off stitches fastened by heat treated heat shrinkable yarn knitted in a terminated end of the rib knitted portion.

2. A method of knitting a knit fabric having a pocket with a rib knitted portion comprising the steps of, in a flat knitting machine having multiple knitting needles positioned parallel on at least a pair of confronting needle beds in a longitudinal direction, knitting a front fabric with front knitting needles and rear knitting needles, knitting the front fabric in the pocket by the knitting needles at one side in the pocket position, and a face side of the pocket by the knitting needles at the other side with side edges of the face side of the pocket braided into the front fabric, feeding heat shrinkable yarn to the knitting needles used in knitting the front fabric at an upper end position of the pocket, transferring stitches to specified empty knitted needles, forming a rib knitting portion at the upper end position of the pocket with the specified knitting needles and the knitting needles used in knitting the face side of the pocket, transferring the stitches from the specified knitting needles forming the rib knitted portion to the knitting needles used in knitting the face side of the pocket to terminate an end, casting off the stitches of the knitting needles of the rib knitted portion so that the knitting needles are empty, knitting the front fabric by transferring the stitches of the knitting needles used in knitting the front fabric at the position opposite to the empty needles into the empty needles, and heating the heat shrinkable yarn at the cast-off stitches to fasten the same.

* * * * *